United States Patent [19]

Cho et al.

[11] Patent Number: 5,077,185

[45] Date of Patent: Dec. 31, 1991

[54] ANTISTATIC ANTIHALATION BACKING LAYER WITH IMPROVED PROPERTIES

[75] Inventors: Thomas B. Cho, E. Brunswick; Ray B. Myers, Howell, both of N.J.

[73] Assignee: E. I. Du Pont de Nemours and Company, Wilmington, Del.

[21] Appl. No.: 676,543

[22] Filed: Mar. 28, 1991

[51] Int. Cl.[5] ..... G03C 1/76

[52] U.S. Cl. ..... 430/510; 428/341; 428/427; 430/271; 430/273; 430/523; 430/527; 430/528; 430/529; 430/530; 430/531; 430/950; 430/961

[58] Field of Search ..... 428/341, 427; 430/271, 430/273, 527, 529, 531, 533, 950, 961, 523, 528, 510, 517

[56] References Cited

U.S. PATENT DOCUMENTS

| | | | |
|---|---|---|---|
| 3,551,152 | 12/1970 | Mickey et al. | 430/523 |
| 3,753,765 | 8/1973 | Morgan | 430/527 |
| 3,785,001 | 1/1974 | Van Paesschen et al. | 430/527 |
| 4,225,666 | 9/1980 | Schadi, III | 430/529 |
| 4,301,239 | 11/1981 | Miller | 430/527 |
| 4,374,924 | 2/1983 | Yokoyama et al. | 430/528 |
| 4,396,708 | 8/1983 | Ogawa et al. | 430/529 |
| 4,407,937 | 10/1983 | Sugimato et al. | 430/527 |
| 4,585,739 | 4/1980 | Cho | 430/527 |
| 4,701,403 | 10/1987 | Miller | 430/527 |
| 4,916,011 | 4/1990 | Miller | 430/531 |

*Primary Examiner*—Jack P. Brammer

[57] ABSTRACT

An element comprising a support having an antistatic layer applied to one side thereof and wherein said antistatic layer also contains antihalation dyes absorbing light at 440 nm and below and with matte particles therein, is described. A photosensitive layer, e.g., photographic silver halide layer can be coated on the opposite side of the support. The element exhibits excellent antistatic and antihalation properties as well as low dye stain and improved dimensional stability, compared to elements wherein the antihalation dyes are coated in a separate layer. These products are especially useful as so-called "bright-light films" that are designed for contact printing and the like.

7 Claims, 1 Drawing Sheet

ANTISTATIC ANTIHALATION BACKING LAYER WITH IMPROVED PROPERTIES

FIELD OF THE INVENTION

This invention relates to an element containing a permanent antistatic layer. More particularly this invention relates to a photosensitive element wherein the antistatic layer contains other materials including an antihalation dye.

BACKGROUND OF THE INVENTION

Supports useful in conjunction with photosensitive layers are usually transparent films and the like. Dimensionally stable polyethylene terephthalate film is especially useful. However, many of these film supports generate considerable static on their surface during handling and this cannot be tolerated since the static will tend to give unwanted exposure to the photosensitive layers applied thereon. In order to reduce the propensity of the film to generate static, it has been the practice to coat an antistatic layer on the film support. Such a layer is well-described by Miller, U.S. Pat. No. 4,916,011, Apr. 10, 1990, and the references discussed in that patent. However, it is sometimes necessary to provide alternative layers such as antihalation layers or layers containing matte particles and the like on the photosensitive element. Thus, the alternative layers are usually applied over the antistatic layer and sometimes this is undesirable because the film begins to lose the antistatic qualities and the presence of these additional layers impart other qualities such as decreased dimensional stability, especially during changes in relative humidity. Other layers designed to transmit the antistatic properties to the surface have been successfully tried but when this additional layer is present is is sometimes undesirable since image quality and the aforementioned dimensional stability suffer.

Thus, there is a pressing need to provide an element having a single layer which has both antistatic qualities and antihalation properties and the element thereby exhibits improved dimensional stability and image quality. Also, there is a need to decrease dye stain in photographic elements, said stain being caused by the presence of antihalation dyes in standard backing layers.

SUMMARY OF THE INVENTION

In accordance with this invention there is provided an element comprising a film support having coated thereon at least one permanent antistatic layer, said layer comprising (1) a water-soluble, electrically conductive polymer having functionally attached carboxyl groups integral to the polymer, (2) a polyfunctional substituted aziridine wherein at least one hydrogen atom on a carbon atom of the aziridine ring is substituted with an alkyl substituent wherein the alkyl is from 1 to 6 carbon atoms, wherein the aziridine interlinks the water-soluble, electrically conductive polymer having functionally attached carboxyl groups integral to the polymer to said film support, (3) at least one antihalation dye, said dye adsorbing light at less than 440 nm, and (4) at least one matte agent, said antistatic layer having a coating weight, based on the weight of the conductive polymer (1), of between 4.5 and 20 $mg/dm^2$, wherein said antistatic antihalation layer exhibits improved dimensional stability.

BRIEF DESCRIPTION OF THE DRAWINGS

The accompanying Figures form a material part of this disclosure wherein.

DISCLOSURE OF THE INVENTION

Figure 1:
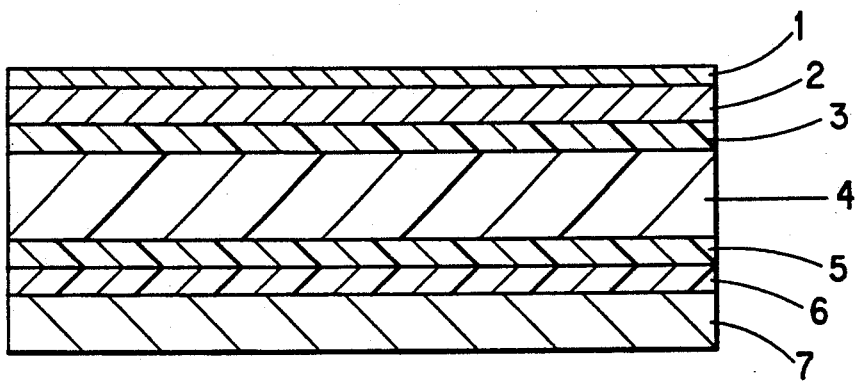
FIG. 1 (PRIOR ART)
FIG. 1 illustrates a schematic view in cross section of a photographic element of the prior art having a photographic emulsion coated on one side of a support and an antistatic layer and a backing layer coated on the backside of the support.
Figure 2:
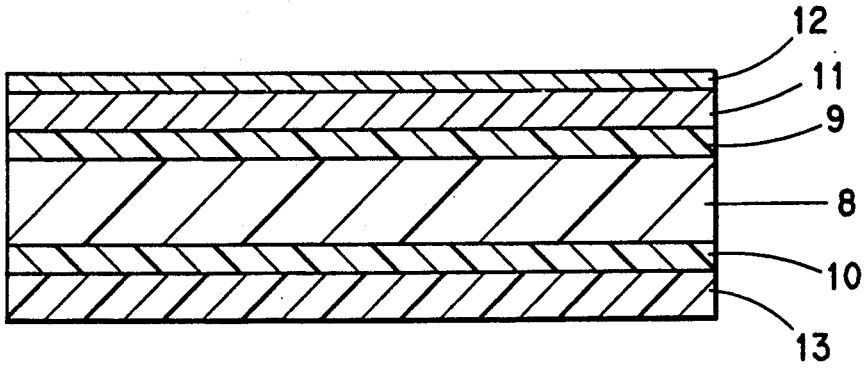
FIG. 2 illustrates a schematic view in cross section of a photographic element of the invention having a photographic emulsion coated on one side of a support and a single antistatic layer containing antistatic as well as antihalation properties coated on the backside of the support.

Referring now specifically to the drawing, FIG. 1 shows a prior art element wherein 4 is a film support, e.g., dimensionally stable, polyethylene terephthalate, on which a resin sublayer has been coated on both sides as shown by layers 3 and 5. Over the sublayer 5 a thin substratum of gelatin may be applied (not shown) so that a photosensitive layer 2, e.g., gelatino silver halide photographic layer, may be coated. An antiabrasion layer 1 is applied supra to the photosensitive layer. On the back side of the film support 4, an antistatic layer 6 is applied followed by a backing layer 7 which may contain antihalation dyes among other elements. In comparison, FIG. 2 shows a comparable element prepared according to the teachings of this invention. The film support is shown as 8 while the resin sublayers are shown as 9 and 10. Again, a gelatin sublayer (not shown) may also be present over resin sublayer 9 in order to improve the adhesion and coatability of the photosensitive layer 11, e.g., gelatino silver halide photographic layer. An antiabrasion layer 12 is applied to protect photosensitive layer 11. On the back side of the element, there is only one layer over resin sublayer 10 shown as 13. This is the layer of the instant invention which contains a novel combination of antistatic and antihalation properties described more fully below.

Antistatic backing layers useful in this particular invention include those layers disclosed in Miller, U.S. Pat. No. 4,916,011, the pertinent disclosures of which is incorporated herein by reference. Photographic film elements, for example, which contain this antistatic layer will exhibit excellent antistatic properties. An additional improvement is in the manufacture of film supports containing the antistatic-antihalation layer of this invention. This layer may be applied to the film support during the manufacture thereof resulting in considerable coating cost savings. As previously mentioned, there is always a need for layers which serve alternative means. For example, there is often a need to prepare a photographic element which will employ an antihalation layer in order to improve the sharpness of the images generated thereon. Such layers are taught in Cho, U.S. Pat. No. 4,485,730, the pertinent disclosures of which is also incorporated herein by reference. Although these layers do indeed provide adequate antihalation and insure that the integrity of the antistatic layers of Miller U.S. Pat. No. 4,916,011 over which they may be coated, are maintained, these films exhibit a somewhat reduced dimensional stability especially when there is a change in the relative humidity (RH).

Additionally, since the antihalation dyes are incorporated in a layer somewhat removed from the photosensitive, image-forming layer, the image quality can be affected.

For the purposes of this invention, a photosensitive element may comprise a film support made from dimensionally stable polyethylene terephthalate film have a resin sublayer coated on both sides. On one side of the support (the so-called "back-side") an antistatic layer of Miller containing antihalation dyes which adsorbs at 440 nm or less and matte particles will be coated. On the other side of the support, a thin, anchoring substratum of gelatin will be applied followed by, for example, a gelatino silver halide photographic (photosensitive) layer. An antiabrasion layer will be applied supra to this photosensitive layer.

Specific antihalation dyes useful within the ambit of this invention include those described in Cho U.S. Pat. No. 4,485,730. These are mixtures of dyes such as SF Yellow and Acid Violet Dyes as well as the other yellow dye taught therein. Other antihalation dye or dyes which will adsorb at 440 nm or below of the spectrum and which are easily discharged within the processing fluids used to develop and fix the photographic image formed within this element, may also be used. Some of these dyes, together with their structures, are shown below:

Yellow Dye (1)

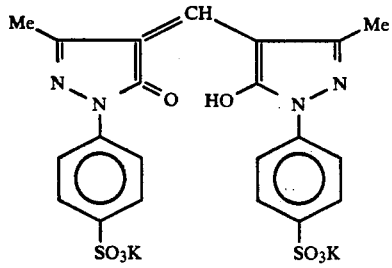

CAS NO. 34142-26-2

Acid Violet Dye (2)

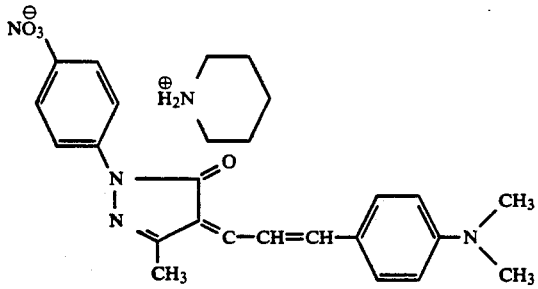

CAS NO. DP495-28-7

Blue Dye (3)

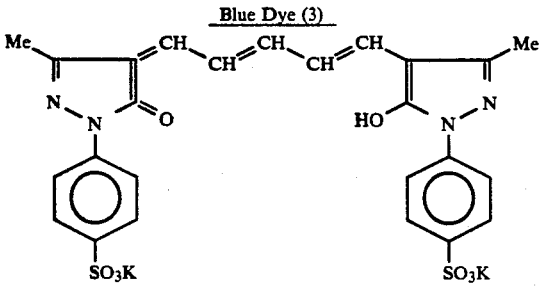

-continued

CAS NO. 65059-52-1

It is also desirable to use matte particles, e.g., various silicas, polymethacrylate beads, etc. within the antistatic/antihalation layer of this invention to insure that the photographic element can be handled adequately. Thus, the element of this invention is sometimes exposed within a vacuum frame, for example, together with the target image to be applied thereon. When such an element is used, matte particles present within this antistatic/antihalation layer will insure that intimate and proper contact is maintained between the photographic film and the image. This is sometimes called "draw-down". Preferable matte particles include the various silicas that are well-known to those skilled in the photographic art. These relatively inert materials include fumed silica such as that sold by Davidson Labs. Inc., Davidson, NC (Davidson Silica #72), among others. Particle sizes of these silicas range from about 3 to 7$\mu$ and are usually added in the range of about 0.5 to 10 g per 200 g of total backing present, based on solids. Preferably, we will add these matte particles in a range of 1.0 to 5.0 g per 200 g of total backing present, based on solids.

Various transparent support elements useful in the field of photography and the like, may be used herein to contain the antistatic-antihalation layer of this invention. Preferred are the dimensionally stable polyethylene terephthalates well-known to those skilled in the art. These films (herein called "polyester films") are made as taught in Alles, U.S. Pat. No. 2,779,684 and Rawlins, U.S. Pat. No. 3,567,452 and the patents cited therein. However, we are not limited to the use of polyester films as other supports can be used that have available carboxyl groups on their surface. For example, a paper support with a plastic overcoat, e.g., polyethylene which was flame treated or reacted to form carboxyl groups on its surface, might also be used. In fact, this invention could be useful in providing such a layer on any of said supports with carboxyl, hydroxyl, amino, or thiol surface groups thereon. Of course, the polyester supports made and subbed as disclosed in the aforementioned Alles and Rawlins patents are particularly preferred. The resin sub is not necessary, however, if the polyester film support is energy- or chemically-treated to form such active carboxyl sites directly on the support itself.

The photosensitive and/or radiation sensitive layers useful within the present invention may be any which are well-known for imaging and reproduction in fields such as graphic arts, printing, medical and information systems. Those that may be mentioned include photopolymer, diazo, and vesicular, in addition to silver halide imaging systems.

Particularly useful imaging systems are those that employ silver halide emulsion layers. Gelatino, silver halide elements useful within the ambit of this invention are legion in number and include silver bromide, silver iodide, silver chloride or mixtures of two or more of these halides. These silver halides may be made by any of the conventional processes to yield any of the conventional crystal shapes such as cubic, rhombic, tabular, etc. These elements are useful as negative or positive-working systems for the recording of images thereon.

The silver halide emulsions may contain sensitizers which include labile sulfur compounds such as sodium thiosulfate and thionex, for example, as well as metal salts such as gold thiocyanate. Other adjuvants such as antifoggants, stabilizers, dyes, wetting and coating agents, antistatic agents, hardeners, etc., may also be present within these systems.

The emulsions prepared according to the teachings of this invention may be coated on the support of this invention by any of the standard, well-known coating procedures, e.g., skim, bar, slide, etc., on any of the conventional supports, e.g., paper, films, etc. Particularly preferred supports include dimensionally stable polyethylene terephthalate on which thin, substratums of resins and gel layers have been previously coated in order to enhance the coating of the aqueous emulsions. After the emulsion layer or layers have been applied, thin, hardened gelatin protective layers may be applied supra thereto.

EXAMPLES

This invention will now be illustrated by the following specific examples wherein the percentages are by weight and of which Example 1 is considered to be the best mode.

EXAMPLE 1

The novel backing antistatic-antihalation layer of this invention was prepared by mixing the following ingredients:

| Ingredient | Amount |
|---|---|
| Deionized Water | 22.25 gal |
| M-1125[1] | 188 gm |
| Deionized Water - Mixed | 3,000 gm |
| D-790 Dye[2] | 10.12 lbs |
| D-724 Dye[3] | 9 lbs 4 oz |
| D-798 Dye[4] | 19.0 lbs |
| Deionized Water Rinse | 10.0 lbs |
| 1-aziridinepropanoic acid 2-methyl-2-ethyl-2-[3-(2-methyl-1-aziridinyl-1-oxo-propoxyl]-1,3-propandiyl ester CAS #64-265-57-2, formula $C_{24}H_{41}N_3O_6$) MW 467.61 hereinafter referred to as "PFAZ ® 322", Sybron Chemicals, Inc., Birmingham, NJ | 1 lb 13 oz |
| Versa ® TL-5 a 25% aqueous solution of a 3/1 copolymer of Na-styrene sulfonate/maleic anhydride, National Starch and Chemical Co., Bridgewater, NJ | 60 lbs |
| 10% aqueous solution of Cetyl Betaine | 2 lbs 11 oz |
| 7% aqueous solution of $H_2SO_4$ (Rohm & Haas Co., Philadelphia, PA) | 7 lbs 13 oz |
| Rhoplex ® WL81 An acrylic copolymer aqueous solution (41–43%) containing trace amounts of ammonia and formaldehyde, Rohm and Haas Co., Philadelphia, PA | 7 lbs 3 oz |
| Deionized Water Rinse | 28 lbs |

[1]A mixture of silica particles (Davidson Labs Inc.; Silica #72, particle size 3.1–4.1μ) 16.8% by weight neomycin sulfate (32 ppm), gelatin (6.7% by weight) and water (76.5% by weight)

[2]D-790 dye manufactured by E. I. du Pont de Nemours and Co., Wilmington, DE is of the formula:

Yellow Dye (1)

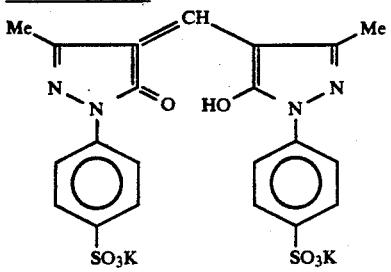

-continued

[3]D-724 dye manufactured by E. I. du Pont de Nemours and Co., Wilmington, DE is of the formula:

Acid Violet Dye (2)

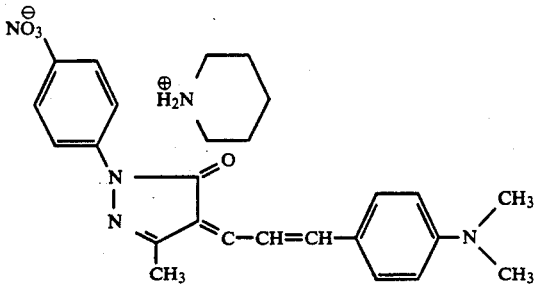

[4]D-798 dye manufactured by E. I. du Pont de Nemours and Co., Wilmington, DE is of the formula:

Blue Dye (3)

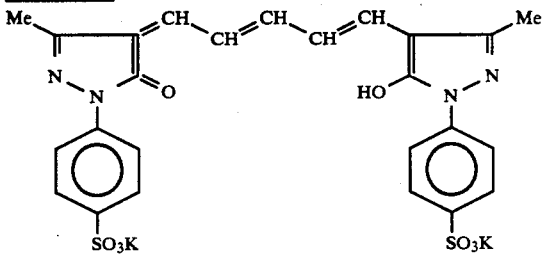

After thoroughly mixing these ingredients, they were coated on a 0.004 inch (0.1016 mm) dimensionally stable polyethylene terephthalate film support on which was coated on both sides a resin sublayer such as mixed polymer subbing compositions of vinylidene chloride/itaconic acid as taught in Rawlins U.S. Pat. No. 3,567,452.

After coating the antistatic-antihalation layer, a thin substratum 0.8 mg/dm$^2$ (0.06 micrometer) of gelatin was coated over the resin sub on the opposite side of the film support and a gelatino, silver halide emulsion comprising 100 mol percent silver bromide that had been brought to its optimum sensitivity with gold and sulfur and which contained a hydrazine compound, was coated 48 mg/dm$^2$ over this gelatin substratum. This emulsion also contained the standard antifoggants, coating aides, hardeners, etc. and is termed a "bright-light" emulsion since it can be safely handled in room lights without deleterious exposure of the photosensitive layer. In addition, the emulsion may also contain spectral sensitizing dyes which give sensitive at 440 nm and below. A hardened gelatin antiabrasion layer was coated supra to this emulsion layer and all was fully dried to give an element as shown in FIG. 2. For comparison purposes, an element prepared according to Cho, U.S. Pat. No. 4,585,730, Example 1, was also prepared. This element had the structure as shown in FIG. 1.

These two elements were sampled, exposed from 5 to 20 seconds on a Violux ® 5002.5 exposure unit manufactured by Douthitt Co., Detroit, Mich., developed, fixed, washed and dried. While both samples had excellent static protection which was tested as described in Cho U.S. Pat. No. 4,585,730, the coating made according to that teaching had some residual dye stain as compared to that of this invention. In addition, the element of this invention exhibited greater dimensional stability. This latter test involves the following:

Test 1—Measurement of Film Instantaneous-Size-Change (ISC):

In this test, a film strip ca. 1" by 18" (2.54 cm by 45.72 cm) is equilibrated at a constant temperature and a low relative humidity (RH about 20%) and the size (length) is measured. Then, the RH is quickly increased to about 60% and the film size measured again. The size change is calculated and described as the ISC.

Test 2—Measurement of Film RH-coefficient (RHco):

In this test, a film strip, ca. 1" by 18" (2.54 cm by 45.72 cm) is equilibrated at constant temperature and low RH (ca. 20%) and the size (length) is again measured. The RH is then increased to ca. 60% and the film equilibrated for greater than 12 hours at this higher RH. The size change is calculated and described as RHco.

The film of this invention showed less size change than that of the prior art. Sensitometric results were equivalent.

EXAMPLES 2-17

In these examples, a series of coatings representing the metes and bounds of this invention were made. The conductive polymer was changed from that described in Example 1. In that example, the conductive polymer was described as an anionic crosslinkable conductive polymer (Versa® TL-5), while in these examples, two other cationic crosslinkable conductive polymers (Conductive Polymer 7091RV, a dimethyldiallyl ammonium chloride/diacetone acrylamide copolymer, 40% solution, and E1373, a dimethyl diallyl ammonium chloride/methylolacrylamide copolymer) made by Calgon Corp., Pittsburgh, Pa. were evaluated along with an alternative crosslinking agent (Resinset® Insolubilizer 656-4 a melamine-formaldehyde condensate, 65% solution) made by Harbor Chemical Co., Livingston, N.J. Other ingredients such as wetting agents, matte particles, dyes, etc., were added to each of the coatings as described in Example 1. The pH of each coating made was adjusted as shown in Table 1 below and the amount of each of the conductive polymers used and the level of the crosslinking agent used was also varied as shown in Table 1. Each example was coated on polyester film and dried as previously described and the resistivity (ohms/□) measured by the methods described in Cho, U.S. Pat. No. 4,585,730, where a lower number indicates better static protection. For control purposes, a film coated without any of the conductive polymer and crosslinking agent was used. The following results were obtained:

TABLE 1

| | | % Solids in Coating | | | |
|---|---|---|---|---|---|
| Ex. | Cond. Poly. 7091RV | Cond. Poly. E1373 | Resinset Insolubilizer 656-4 | pH | Resistivity |
| 2 | 96 | — | 4 | 5.5 | $6.7 \times 10^7$ |
| 3 | 93 | — | 7 | " | $4.1 \times 10^7$ |
| 4 | 90 | — | 10 | " | $2.7 \times 10^7$ |
| 5 | 87 | — | 13 | " | $8.9 \times 10^7$ |
| 6 | 96 | — | 4 | 6.5 | $9.5 \times 10^7$ |
| 7 | 93 | — | 7 | " | $4.53 \times 10^7$ |
| 8 | 90 | — | 10 | " | $2.3 \times 10^7$ |
| 9 | 87 | — | 13 | " | $8.7 \times 10^7$ |
| 10 | — | 96 | 4 | 5.5 | $7.9 \times 10^7$ |
| 11 | — | 93 | 7 | " | $1.1 \times 10^7$ |
| 12 | — | 90 | 10 | " | $2.2 \times 10^7$ |
| 13 | — | 87 | 13 | " | $9.7 \times 10^7$ |
| 14 | — | 96 | 4 | 6.5 | $8.5 \times 10^7$ |
| 15 | — | 93 | 7 | " | $2.1 \times 10^7$ |

TABLE 1-continued

| | | % Solids in Coating | | | |
|---|---|---|---|---|---|
| Ex. | Cond. Poly. 7091RV | Cond. Poly. E1373 | Resinset Insolubilizer 656-4 | pH | Resistivity |
| 16 | — | 90 | 10 | " | $1.3 \times 10^7$ |
| 17 | — | 87 | 13 | " | $8.4 \times 10^7$ |
| Control | — | — | | | $1.0 \times 10^{18}$ |

These results clearly show that the elements representing this invention produce a low propensity to produce static compared to the control. All of the dyes discharged adequately and no stain was observed.

As can be seen, the single, antistatic-antihalation coating of this invention had superior dimensional stability compared to controls. This was a surprising discovery since it was not thought that a simple change in antistatic layer to include the antihalation dyes and matte particles would cause such an Improvement. In addition, the image quality of the sample of this invention was better and the dye stain lower while all of the antistatic properties and antihalation properties were preserved.

We claim:

1. An element comprising a film support having coated thereon at least one permanent antistatic layer, said layer comprising (1) a water-soluble, electrically conductive polymer having functionally attached carboxyl groups integral to the polymer, (2) a polyfunctional substituted aziridine wherein at least one hydrogen atom on a carbon atom of the aziridine ring is substituted with an alkyl substituent wherein the alkyl is from 1 to 6 carbon atoms, wherein the aziridine interlinks the water-soluble, electrically conductive polymer having functionally attached carboxyl groups integral to the polymer to said film support, (3) at least one antihalation dye, said dye adsorbing light at less than 440 nm, and (4) at least one matte agent, said antistatic layer having a coating weight, based on the weight of the conductive polymer (1), of between 4.5 and 20 mg/dm$^2$, wherein said antistatic antihalation layer exhibits improved dimensional stability.

2. An element according to claim 1 wherein said matte agent is finely divided fumed silica and is present in the range of 0.5 to 10.0 gm/200 gm of backing present, based on total solids.

3. An element according to claim 1 wherein there is a plurality of antihalation dyes present.

4. An element according to claim 3 wherein said dyes are:

Yellow Dye (1)

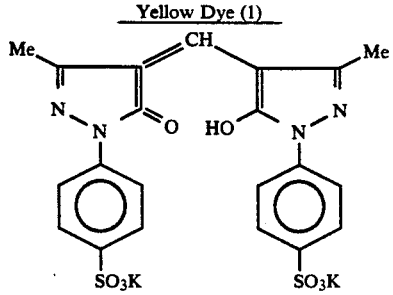

Acid Violet Dye (2)

-continued

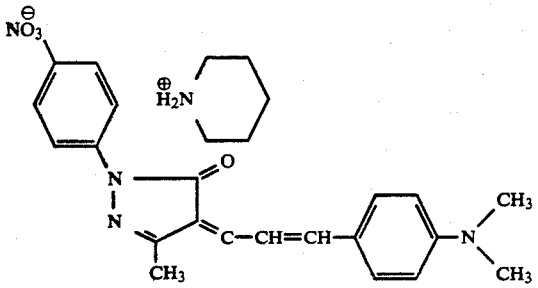

Blue Dye (3)

-continued

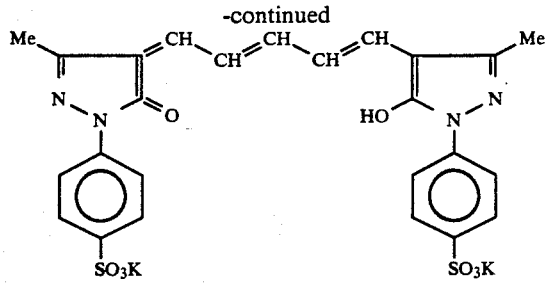

5. An element according to claim 1 wherein said support is dimensionally stable polyethylene terephthalate film.

6. An element according to claim 1 wherein coated on the side of the film support opposite the permanent antistatic layer is a silver halide emulsion layer.

7. An element according to claim 6 wherein the silver halide emulsion layer is a gelatino silver chloride emulsion layer with a sensitivity of 440 nm or less.

* * * * *